United States Patent [19]

Chwae

[11] 4,240,232

[45] Dec. 23, 1980

[54] COATED ABRASIVE SUPERFINISHING STONE AND METHOD OF MAKING SAME

[75] Inventor: John C. Chwae, Appleton, Wis.

[73] Assignee: Giddings & Lewis, Inc., Fond du Lac, Wis.

[21] Appl. No.: 865,882

[22] Filed: Dec. 30, 1977

[51] Int. Cl.[3] ..... B24D 15/02

[52] U.S. Cl. ..... 51/356; 51/267; 51/406; 51/296; 51/297

[58] Field of Search ..... 51/204, 213, 267, 296, 51/297, 356, 406

[56] References Cited

U.S. PATENT DOCUMENTS

| | | | |
|---|---|---|---|
| 2,499,933 | 3/1950 | Smul | 51/273 X |
| 3,267,623 | 8/1966 | Block | 51/406 |
| 3,694,340 | 9/1972 | Takahashi | 51/31 X |
| 3,841,034 | 10/1974 | Held | 51/356 |
| 3,875,703 | 4/1975 | Clemente | 51/406 X |
| 3,918,220 | 11/1975 | Jury | 51/356 X |
| 4,010,583 | 3/1977 | Highberg | 51/356 X |

*Primary Examiner*—Gary L. Smith

*Attorney, Agent, or Firm*—Leydig, Voit, Osann, Mayer & Holt, Ltd.

[57] ABSTRACT

An improved superfinishing stone for micro-finish machining of workpieces and a method of making same. The stone comprises a body of readily machinable metal with a cutting face in the form of an abrasive liner adhesively bonded to a contour face complementary to the contour of the workpiece. Coolant passages within the body of the stone extend through the abrasive liner and adhesive substrate and flush coolant directly between the cutting face and the workpiece.

4 Claims, 19 Drawing Figures

COATED ABRASIVE SUPERFINISHING STONE AND METHOD OF MAKING SAME

DESCRIPTION OF THE INVENTION

The present invention relates in general to the field of superfinishing and, more specifically, to an improved superfinishing stone and to a method of making same. The term "superfinishing" as used herein refers to a well known type of metal cutting operation in which a contoured abrasive stone is held with a predetermined force against a complementally contoured workpiece moving relative to the stone, and in which the surface finish improves with operating time to an asymptotic limit.

In a typical operation, the superfinishing stone is pressed against a rotating workpiece and oscillated rapidly with a relatively small amplitude parallel to the rotational axis of the workpiece. Where the length of the workpiece to be superfinished exceeds the length of the stone, the oscillating stone may at the same time be traversed or reciprocated at a slower rate in a direction parallel to the rotational axis of the workpiece.

A superfinishing operation can be performed on almost any previously machined surface which may have a flat, cylindrical, spherical or other specific configuration. It improves the finish of the previously machined surface by removing surface material or "smear metal" left by the previous machining operation, and by cutting off ridges on the base metal surface of the workpiece. Superfinishing can also effect small corrections in the dimensions or shape of the workpiece. A superfinished surface is also characterized by a pattern of minute scratch marks which are beneficial for purposes of lubrication. Such scratch marks may take the form of a cross-hatched pattern cut by a combination of workpiece and stone movements.

A conventional superfinishing stone is formed as a block of solid abrasive material and relies heavily on a coolant, commonly of relatively high viscosity, flooded over the stone and workpiece surface by means of external supply nozzles or by immersion. Such conventional stones are specially compounded to the user's specifications as to size, grit material, bond and hardness. For economic reasons, these stones must be ordered in large quantities. This results in a substantial investment in stone inventory where a variety of abrasive grits and stone compositions is needed to meet the user's requirements for different workpieces.

Before a conventional superfinishing stone can be placed into use, its cutting face must be shaped to the exact contour of the workpiece by the machinist. This is a laborious and time-consuming process often measured in hours. The stone also tends to have a relatively short life, because wearing away of the stone is a necessary requirement for continuous renewal of the cutting surface.

With the foregoing in mind, the general aim of the present invention is to enhance the commercial acceptance of the superfinishing process by overcoming the above-mentioned disadvantages of conventional superfinishing stones.

More specifically, one object of the present invention is to provide a superfinishing stone of substantially more economical construction than a conventional stone, yet capable of producing comparable or better results.

Another object of the invention is to provide a superfinishing stone of the foregoing type which substantially reduces the time required to perform a superfinishing operation as compared with the time required by a conventional stone.

A further object of the invention is to provide a superfinishing stone of the character set forth above having a metallic body with a contour surface preformed to complement the workpiece and a cutting surface in the form of a coated abrasive liner adhesively secured thereto.

Another object is to provide a superfinishing stone of the foregoing type wherein the body is formed with coolant supply and discharge passages adapted to flush low viscosity coolant between the cutting face and the workpiece in a manner which efficiently removes chips and greatly reduces clogging of the abrasive material of the cutting face.

A further object is to provide a simple and economical method of making a coated abrasive superfinishing stone of the type set forth above.

Other objects and advantages of the invention will become apparent from the detailed description which follows, taken with the accompanying drawings, wherein.

Figure 2:
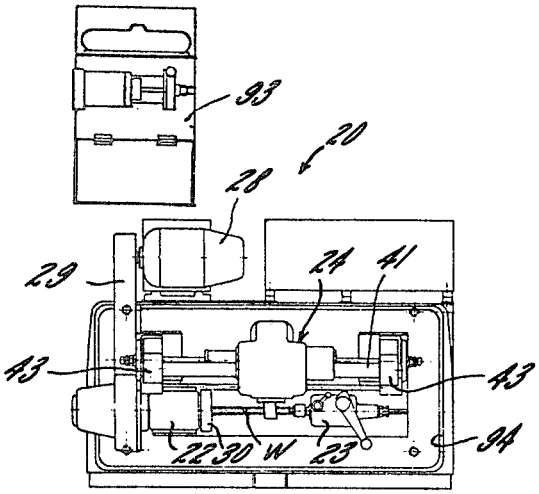
FIG. 2 is a plan view of the illustrative machine shown in FIG. 1.
Figure 1:
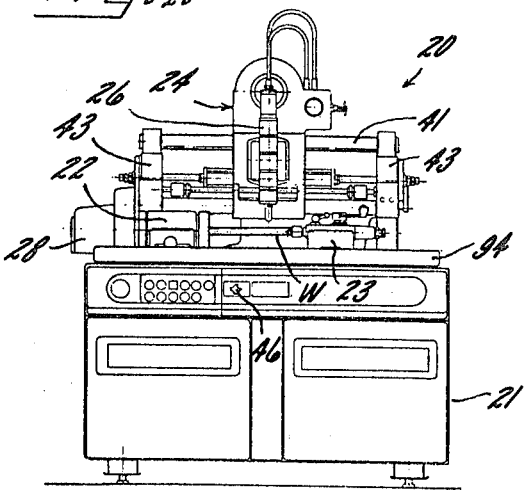
FIG. 1 is a front elevational view of a superfinishing machine illustratively embodying the invention.
Figure 4:
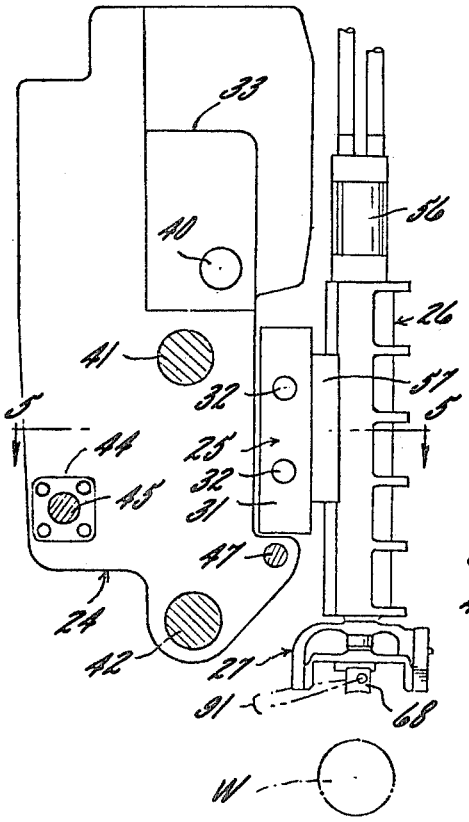
FIG. 4 is a side elevational view of the structure shown in FIG. 3.
Figure 3:
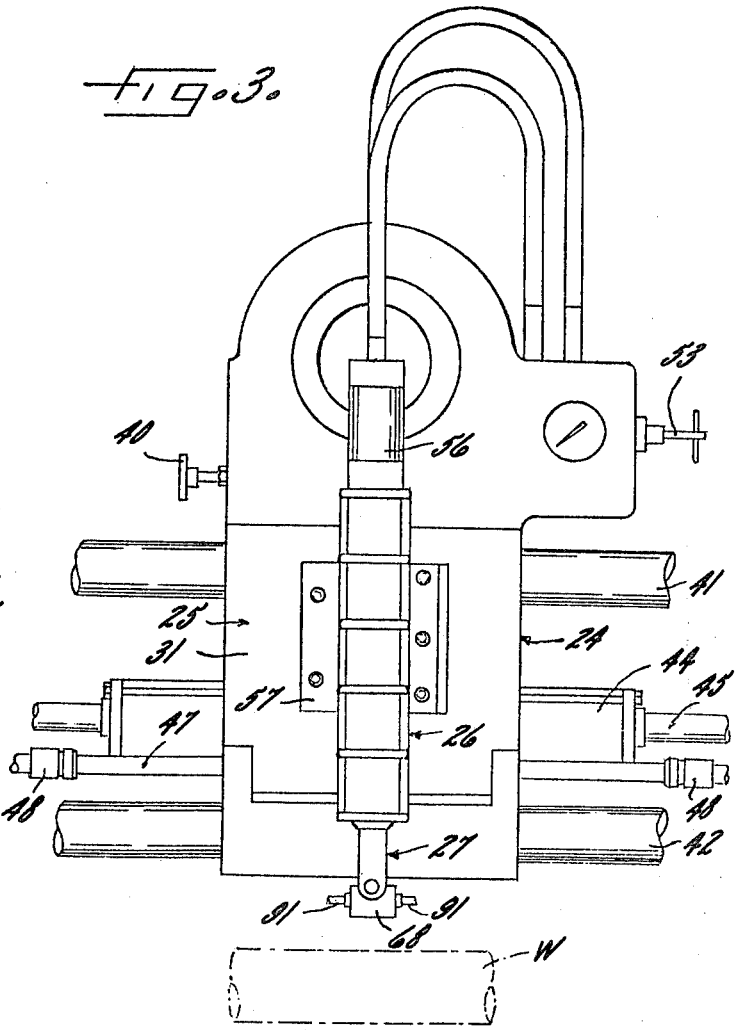
FIG. 3 is an enlarged elevational view of the traversing slide supporting the oscillating head and stone quill in the machine shown in FIG. 1.

While the invention is susceptible of various modifications and alternative constructions, certain illustrative embodiments have been shown in the drawings and will be described below in considerable detail. It should be understood, however, that there is no intention to limit the invention to the specific forms disclosed but, on the contrary, the intention is to cover all modifications, alternative constructions, and equivalents falling within the scope of the appended claims.

Referring more specifically to FIGS. 1–8, it will be noted that the environment for the present invention is an illustrative superfinishing machine 20 of a well known form such, for example, as the Gisholt Model 52A Superfinisher or the Giddings & Lewis Bickford Model 863 superfinishing machine. The machine comprises a main frame or base 21 which supports a headstock 22, a tailstock 23 and a traversing slide 24. The latter includes an oscillating head 25 which serves as a mounting for a stone quill assembly 26 and stoneholder assembly 27. The headstock 22 is power driven by spindle drive motor 28 via an adjustable speed drive 29 including adjustable sheaves and a connecting belt. The headstock 22 is provided with a collet chuck 30 which drivingly engages one end of a workpiece W rotatably supported between the headstock and the tailstock. In order to accommodate workpieces of varying size and configuration, the tailstock 23 may be adjustably positioned longitudinally of the base by T-slot and clamping bolt means.

The oscillating head 25 (FIGS. 3–5) comprises a box like housing 31 mounted on the traversing slide 24 for rapid reciprocating movement of small amplitude parallel to the rotational axis of the workpiece. The housing 31 includes a pair of stub shafts 32 which slidably engage support sleeves in the head 25. An oscillator drive motor 33 is mounted on top of the traversing slide 24 and connected to the head 25 by means of an eccentric shaft 34 and an adjustable speed belt drive 35. The eccentric shaft 34 is journalled in appropriate bearings 36 within the traversing slide 24 and is fashioned with an eccentric 37 on its outer end. The eccentric 37 carries an anti-friction bearing 38 which is nestingly received within a recess in the oscillating head housing 31. The opposed walls of the recess are lined with hardened inserts 39 of carbide or similar material which are engaged by the outer race of the eccentric bearing 38. As the eccentric shaft 34 is rotated, the head 25 is oscillated in a horizontal direction parallel to the rotational axis of the workpiece. In the illustrative machine 20, the rate of reciprocation may be varied between 0 and 660 cycles per minute by turning rate adjusting screw 40 on the traversing slide 24. The screw 40 adjusts the speed of the belt drive 35 in a well known manner.

The traversing slide 24 (FIGS. 3, 4) is adapted to reciprocate the oscillating head 25, stone quill assembly 26 and stoneholder assembly 27 at a relatively slow rate in a direction parallel to the rotational axis of the workpiece. Its function is to accommodate those work pieces where the area to be superfinished exceeds the length of a single stone or a pair of stones used in tandem. The slide 24 is slidably supported on a pair of vertically spaced guide bars 41, 42 which extend between a pair of upstanding support brackets 43 adjacent either end of the base 21.

A horizontal traversing cylinder 44 mounted on the slide 24 overhangs the latter at both ends. The cylinder 44 slidably engages a fixed piston (not shown) mounted centrally of the base on piston rod 45 which is fixed to the support brackets 43. Movement of the slide 24 in either direction may be effected by injecting pressure fluid into one end of the cylinder 44 and exhausting fluid from its opposite end. The rate of slide movement may be controlled by traverse control knob 46. Reversal of slide movement is effected by means of a traverse shift bar 47 and a pair of reversing blocks 48. Engagement of the slide 24 with either block 48 serves to reverse the flow of pressure fluid to and from the traversing cylinder 44.

The stone quill assembly 26 (FIGS. 3–7) comprises a slide defined by trough member 49 and a cap member 50 which form an inner channel of generally square cross-section. The opposing side walls of the channel are accurately finished to define opposed pairs of parallel guide surfaces. The stone quill 53, also of generally square cross-section, is provided with corresponding opposed parallel faces and is slidably mounted within the channel. At its lower end, the quill 53 is provided with a mounting boss 51 and internal bore 52 for engaging the master stoneholder assembly 27. At its upper end, the quill is formed with a bore 54 which engages a connecting member 55 fixed to the piston rod of an air cylinder 56 mounted on top of the trough and cap members 49, 50. The cylinder 56, through valve 56A, is adapted to exert a preselected downward pressure on the quill and the stoneholder assembly 27 when the machine is in operation.

The quill assembly 26 is attached to the oscillating head 25 by means of a saddle plate 57 secured to the latter by cap screws 58. The saddle has a vertically disposed dovetail channel which engages a corresponding dovetail flange 59 on the quill assembly 26. A clamping gib 60 on the saddle plate retains the flange 59 and provides for vertical adjustment of the quill assembly.

Figure 6:
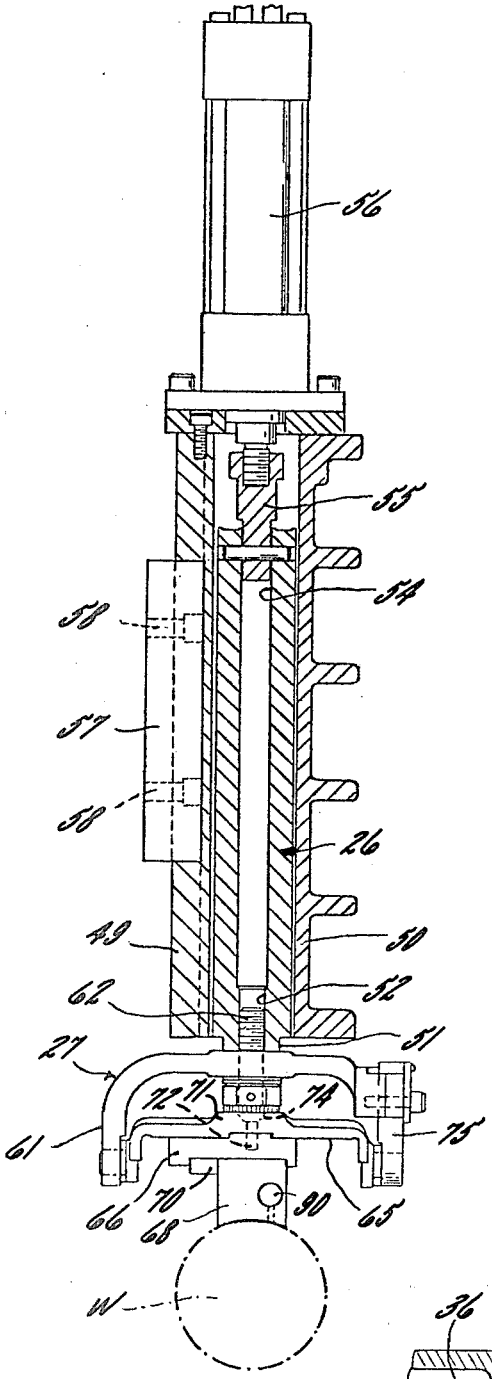
FIG. 6 is an enlarged side elevational view, partially in vertical section, of the quill and stoneholder assemblies of the illustrative machine shown in FIG. 1.
Figure 7:
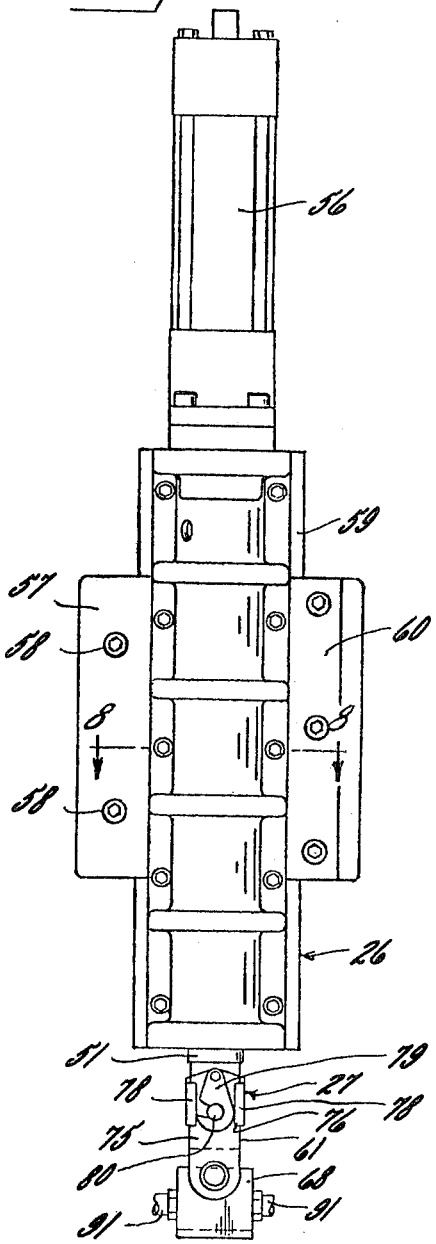
FIG. 7 is a front elevational view of the structure illustrated in FIG. 6.
Figure 5:
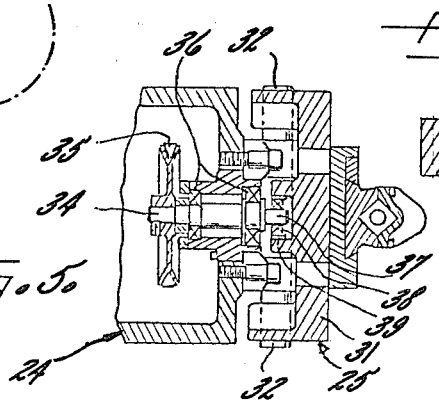
FIG. 5 is a horizontal sectional view taken through the oscillating head and stone quill assemblies in the plane of the line 5—5 in FIG. 4.
Figure 8:
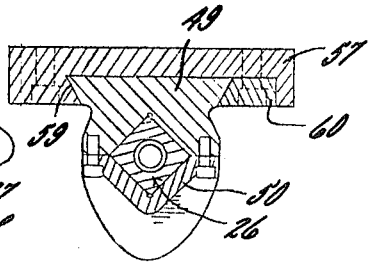
FIG. 8 is a horizontal sectional view taken through the structure illustrated in FIGS. 7 and 8, in the plane of the line 8—8.

The master stoneholder assembly 27 is adapted for attachment to the lower end of the stone quill 53 (FIGS. 6, 7). It comprises a yoke 61 having an upstanding pin 62 adapted to be inserted in any suitable manner as by threaded engagement. Mounted within the yoke 61 is a stoneholder bracket 65 provided with trunnions at its opposite ends which engage the depending lower ends of the stoneholder 66 and superfinishing stone 68, the latter being mounted in a shallow recess 69 in the holder 66 and secured as by means of a wedge element 70. The stoneholder 66 is formed with a boss 71 on its upper surface having a threaded bore 72 therein, the latter being engaged by mounting screw 74 carried on the bracket 65.

In order to permit a stone 68 and its associated bracket 65 to be removed from the stockholder assembly 27, one arm 75 of the yoke 61 is adapted to be removed for that purpose (FIGS. 6, 7). The removable arm 75 is provided with opposed grooves 76 which interfit with corresponding opposed flanges 78 integral with the yoke 61. The arm 75 may be secured in place by means of a latch 79 and cap screw 80, the latter engaging a tapped hole in the body of the yoke 61.

Figure 9:
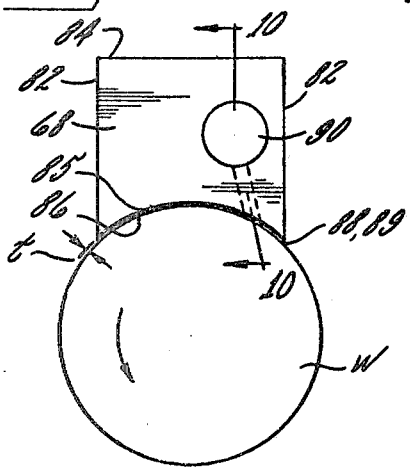
FIG. 9 is an enlarged end view detailing the superfinishing stone of the present invention in working position against a rotating workpiece.
Figure 10:
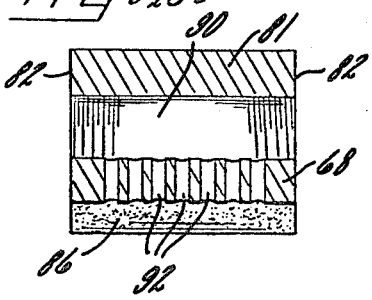
FIG. 10 is a broken sectional view through the superfinishing stone of FIG. 9, taken in the plane of the line 10—10.
Figure 11:
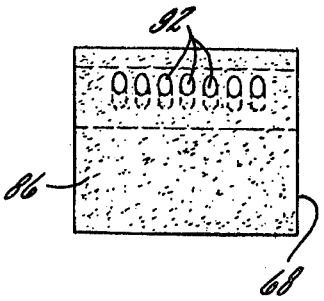
FIG. 11 is a view of the abrasive face of the stone illustrated in FIGS. 9 and 10.

Turning next to FIGS. 9–11, it will be noted that the superfinishing stone 68 exemplifying the present invention comprises a metallic body 81 of block-like form. While the body may be fabricated from various metals, it is preferable to make it from a readily machinable metal such as an aluminum alloy. Exterior side walls 82 and top surface 84 of the body are of rectangular form, being dimensioned to conform to the mounting and holding devices used for prior stones in existing superfinishing apparatus. Its remaining side has an arcuate contour face 85 machined therein which is complementary to the contour of the workpiece W to be superfinished. Since the worpiece in the present instance happens to be of cylindrical form, the contour face 85 defines substantially a segment of the workpiece cylinder.

The contour face 85 supports a correspondingly shaped abrasive cutting face 86 defined by a replaceable coated abrasive liner 88. The latter may, for example, comprise a cloth backing strip with an abrasive coating of diamond grits or grits of a material known under the registered trademark "BORAZON". Various combinations of such abrasives, with or without filter material, may also be used in the liner 88.

The liner 88 is laminated to the contour face 85 by means of a substrate of adhesive material 89 which is somewhat resilient. This enables the abrasive cutting face 86 to follow the contour of the workpiece more uniformly and causes it to wear more evenly than it would with a rigid adhesive. Because of the resiliency of the adhesive, the liner 88 and substrate 89 are compressed to a net thickness t when the stone is pressed against the workpiece for a cutting operation as shown in FIGS. 6 and 9. The radius of the contour face 85 is thus designed to equal that of the workpiece W plus the thickness t. In the present instance, for example, the combined initial thickness of the liner 88 and adhesive substrate 89 is 0.039 inch. When subjected to the pressure of a cutting operation, their net thickness t becomes 0.025 inch. The radius of the contour face 85 is thus equal to the workpiece radius plus 0.025 inch.

Provision is made in the superfinishing stone 68 for forcing a high volume flow of low viscosity coolant directly between the abrasive cutting face 86 and the surface of the workpiece. This is done in such a manner that substantially the entire area of the cutting face is flushed with coolant, thus carrying away chips that would otherwise build up and clog the abrasive of the cutting face. Referring again to FIGS. 9 and 10, it will be noted that the metallic body 81 has a main coolant passage 90 extending longitudinally thereof and parallel to the rotational axis of the workpiece W. In this instance, both ends of the passage 90 are threaded for connection to flexible coolant supply conduits 91 and their associated fittings. A series of coolant discharge passages 92 is disposed in longitudinally spaced relation along the main coolant passage 90. The passages 92 extend laterally from the passage 90, communicating between the latter and the abrasive cutting face 86 through appropriate openings in the adhesive substrate 89 and the abrasive liner 88. The coolant discharge passages 92 are situated so that they enter the abrasive cutting face 86 adjacent to the leading edge of the latter (with respect to the direction of rotation of the workpiece).

A variety of materials may be employed as the coolant used with the superfinishing stone 68. Highly satisfactory results have been obtained with coolant having a viscosity approaching that of water. One such coolant is furnished by the Filamite Company under the number LF-50NR. Coolant is supplied to the stone 68 and the conduits 91 by means of a coolant supply and filter unit 93 situated at the rear of the machine 20 (FIG. 2). The unit 93 includes a circulating pump and appropriate pressure regulating means. Spent coolant is collected in a pan 94 on top of the base 21 and returned to the unit 93.

Renewal of the cutting face 86 of the stone 68 is readily accomplished by peeling off the old abrasive liner 88 and replacing it with a new one which is precut. The laborious and time consuming task of forming the cutting face of each new stone, as required with a conventional solid stone, is eliminated. Moreover, the level of skill required of a machine operator using the new stone 68 is materially reduced.

Figure 12:
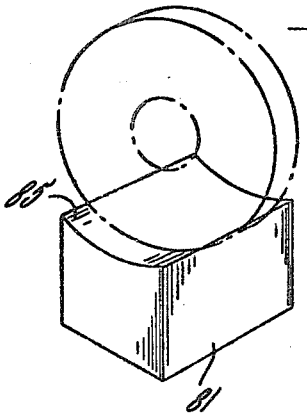
FIGS. 12–17 are sequential views illustrating diagramatically the steps in the method of making a superfinishing stone in accordance with the present invention.

Turning next to FIGS. 12–17, a further aspect of the invention is there exemplified constituting the method of making the superfinishing stone 68. Referring to FIG. 12, it will be noted that the first step involves providing a generally rectangular block of readily machinable metal such as an aluminum alloy for the body 81. The contour face 85 is then formed by milling or otherwise machining in the body 81 a surface complemental to that of the workpiece W. Since the workpiece W in this case happens to be of a cylindrical form, the contour face is formed as a cylindrical segment. As noted earlier herein, the radius of the contour face 85 exceeds the radius of the workpiece by the net thickness t of the abrasive liner 88 and its adhesive substrate 89. Although the contour face in the present instance happens to be of concave form due to the cylindrical shape of the workpiece, the contour face could also be of flat or convex form to accommodate workpieces of different shapes.

Figure 13:
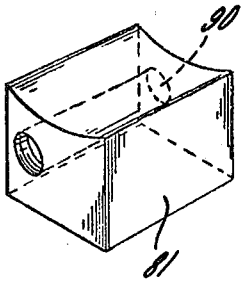

The next step, as shown in FIG. 13, involves drilling or boring the main coolant passage 90 extending longitudinally through the body 81. The ends of the passage 90 are then threaded to receive the fittings connecting it to the coolant supply conduits 91.

Figure 14:
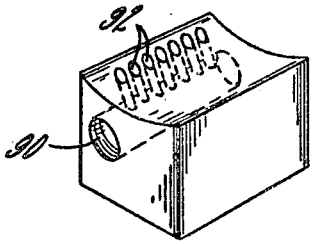

Next, as shown in FIG. 14, the coolant discharge passages 92 are drilled or bored in the stone body between the contour face 85 and the main coolant passage 90. The discharge passages 92 are longitudinally spaced along the contour face 85 and enter the latter adjacent one edge thereof, such edge becoming the leading edge of the contour face and stone body with respect to the direction of rotation of the workpiece W.

Figure 15:
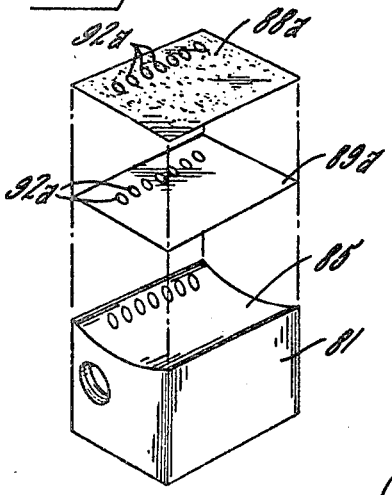

The next step, illustrated in FIG. 15, comprises providing an abrasive liner blank **88*a* and an adhesive substrate material blank 89*a* each coextensive in area with the contour face 85. Each of these blanks is pre-cut and formed with pre-punched openings 92*a* adapted to register with the coolant discharge passages 92**.

The abrasive liner blank **88*a*** is, in the present instance, formed on a cloth backing coated with diamond or BORAZON abrasive. The grit size and concentration of the diamond or BORAZON abrasive may be varied depending upon operating conditions.

The adhesive substrate blank **89*a* is formed from pressure sensitive adhesive material with adhesive properties on both sides. As noted earlier herein, this material is somewhat resilient. The blanks 89*a*** may be precut and sandwiched between two layers of inert material so as to define a tape. Highly satisfactory results have been obtained utilizing adhesive material known as Plate Mount Tape No. 413 furnished by Minnesota Mining and Manufacturing Company.

Figure 16:
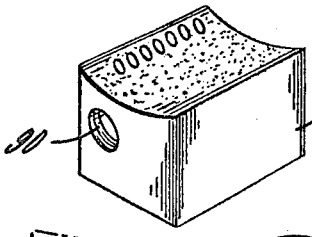

Turning next to FIG. 16, the blanks **88*a*, 89*a* are carefully registered with each other and then placed upon the contour face 85 with the holes 92*a* in registration with the coolant discharge passages 92**.

Figure 17:
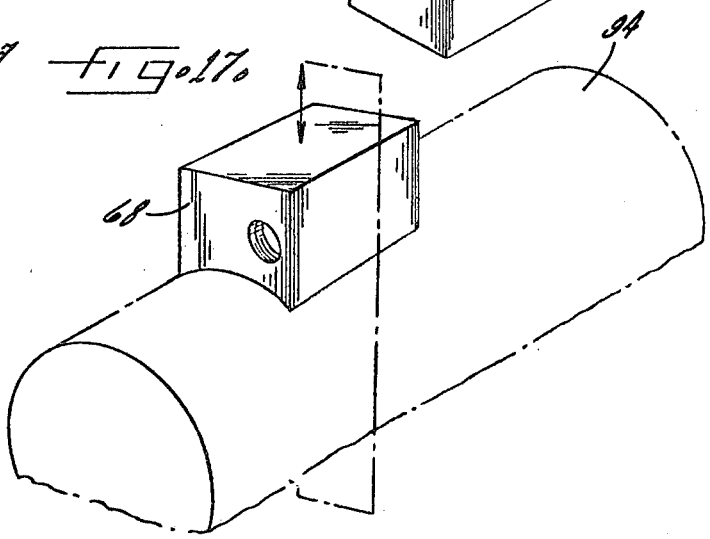

The final step in stone preparation, illustrated in FIG. 17, involves inverting the stone and pressing it tightly, as by means of a C-clamp, against a mandrel 94 corresponding in contour to that of the workpiece W. At that point, the adhesive substrate is set, the abrasive cutting face 86 is properly contoured and the stone is ready to be clamped in the holder and installed in the stone quill assembly. When the stone has been placed in operation, the resilient adhesive substrate 89 yields to the point that the liner 88 and substrate 89 assume their net thickness t.

It will be of interest at this point to summarize the outstanding results obtained by utilizing a superfinishing stone 68 of the type described herein in a superfinishing apparatus such as the machine 20. For convenience, the results obtained in three exemplary runs will be set forth in the following tabulation:

| Parameter | Example I | Example II | Example III |
|---|---|---|---|
| Workpiece Material | 1020 Cold Rolled Steel | Same as I | Same as I |
| Workpiece Diameter | 1.7280 inches | 1.7278 inches | 1.7279 inches |
| Abrasive Material | BORAZON Coated Abrasive | Same as I | Same as I |
| Abrasive Size | 46 Microns | 64 Microns | 64 Microns |
| Abrasive Concentration | 100% | Same as I | 2% BORAZON; 98% Filler |
| Stone Pressure against Workpiece | 80 psi | " | 25 psi |
| Workpiece Rotation | 1300 RPM | " | 450 RPM |
| Stone Oscillation Rate, Cycles per Minute | 550 CPM | " | Same as I |
| Stone Traverse Rate, Seconds per Foot | 25 sec/ft. | " | " |
| Coolant | LF-50NR, Filamite Company | " | " |
| Workpiece Temperature, Maximum | 72° F. | " | 75° F. |
| Ambient Temperature | 68° F. | " | Same as I |
| Surface at start, RMS | Turned, 150–160 RMS | " | Turned, 230–250 RMS |
| Surface after Superfinishing | 4.5–6 RMS | " | 60–110 RMS |
| Metal Removal Rate on Diameter, Inches | 0.0012 | " | 0.0009 |
| Time Elapsed | 12 seconds | " | 12 seconds |

It will be noted from the foregoing that, in Examples I and II, a turned surface of 150–160 RMS was reduced to a superfinished surface of 4.5–6 RMS in only 12 seconds. In Example III, starting with a much rougher turned surface and less favorable parameters, the surface finish was reduced from 230–250 RMS to 60–110 RMS in only 12 seconds.

Figure 18:
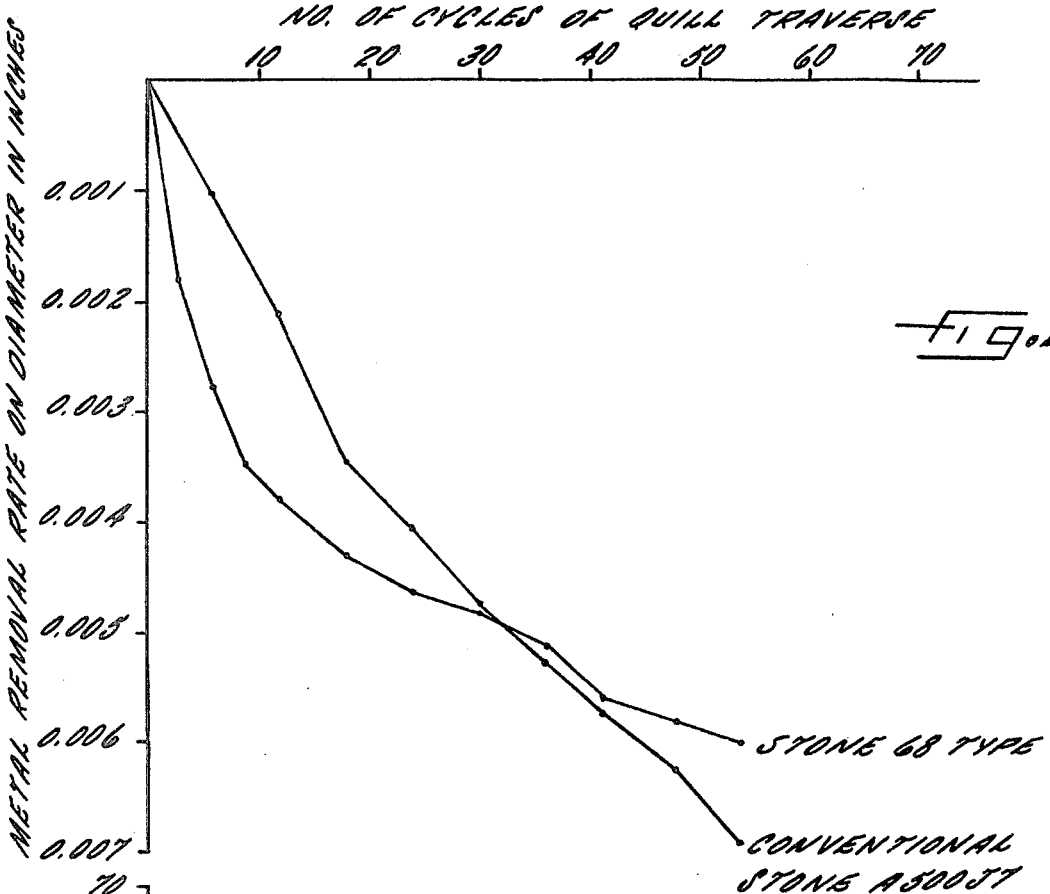
FIGS. 18 and 19 are graphs comparing the characteristics of a superfinishing stone exemplifying the present invention with a prior art superfinishing stone.
Figure 19:
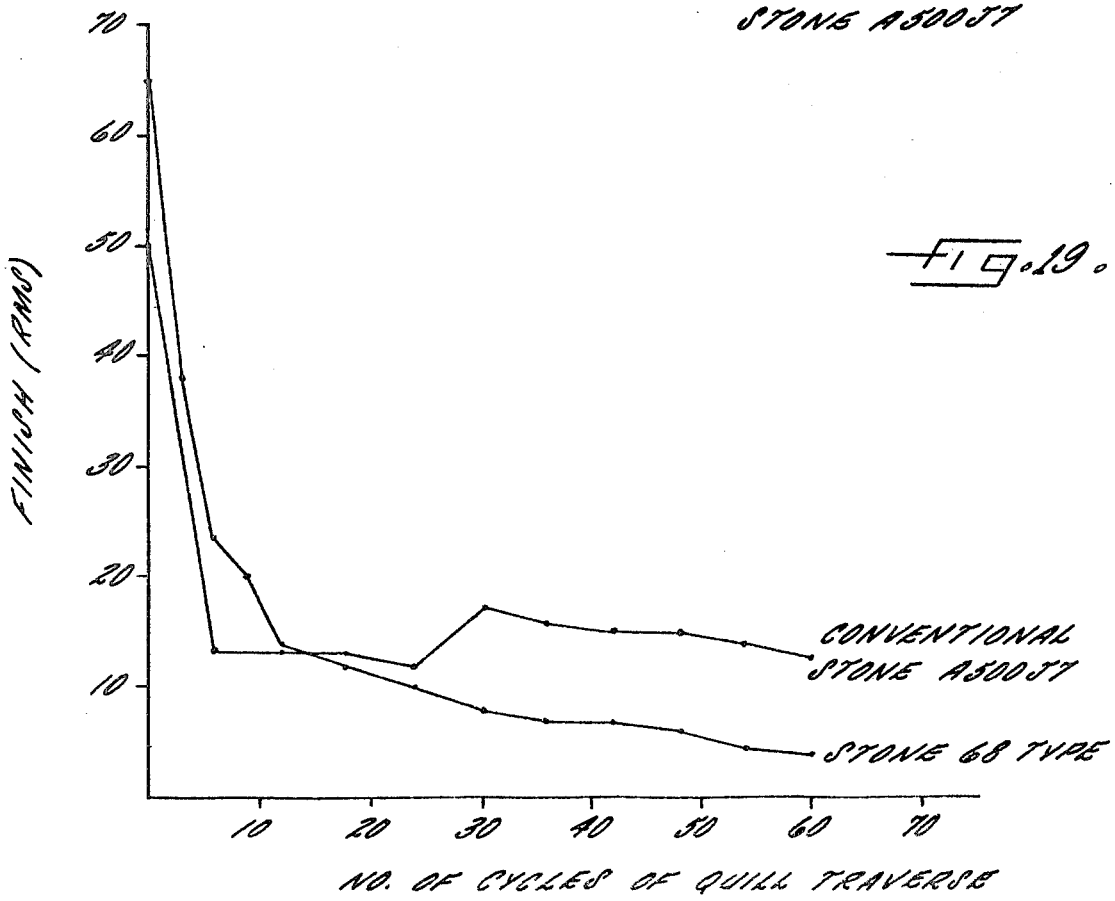

Referring now to FIGS. 18 and 19, a performance comparison is graphically illustrated there between a superfinishing stone 68 of the type described herein and a conventional solid abrasive superfinishing stone operating upon comparable cylindrical workpieces. The relevant parameters are as follows:

| Parameter | Stone 68 Type | A 500 J7 Conventional Stone |
|---|---|---|
| Workpiece Material | 4140 Flame Hardened Steel, 45 Rockwell | 4140 Flame Hardened Steel, 45 Rockwell |
| Workpiece Diameter | 1.7203 inches | 1.7152 inches |
| Abrasive Material | Diamond Coated Abrasive | Solid Aluminum Oxide |
| Abrasive Concentration | 25% Diamond, 75% Filler | J7 Grade |
| Abrasive Size | 30 Microns | 32–33 Microns (500 Mesh) |
| Stone Pressure against Workpiece | 80 psi | 35 psi |
| Workpiece Rotation | 900 RPM | 700 RPM |
| Stone Oscillation Rate, Cycles Per Minute | 500 CPM | 350 CPM |
| Stone Traverse Rate, Seconds per Foot | 42 sec./ft. | 42 sec./ft. |
| Coolant | Symcool 38-A | Vacmold 3D |
| Workpiece Temperature, Maximum | 74° F. | 74° F. |
| Ambient Temperature | 71° F. | 71° F. |

Upon inspection of the graph in FIG. 18, it will be noted that the metal removal rate for each type of stone is plotted against the cycles of quill traverse along the workpiece. It will also be noted that the metal removal rate for the stone embodying the present invention is consistently greater than that for the conventional stone during the first 30 cycles of quill traverse. This difference occurs over the range of operation that includes most superfinishing work and represents a decided advantage over the conventional stone.

FIG. 19 presents a graph with the workpiece finish in RMS plotted against the cycles of quill traverse along the workpiece. Starting with a ground finish of 50 RMS, the conventional stone reduces it to 13 RMS after the first 6 cycles of quill traverse and then levels off for several more cycles. The stone embodying the invention, however, starts with a ground finish of 65 RMS and reduces it to 13 RMS after 14 cycles of quill traverse. At that point the curves across and the stone of the invention continues to improve the finish by reducing the RMS while the conventional stone creates a coarser finish with an increased RMS. It should be noted, however, that the stone of the invention reduced the finish from 65 to 23 RMS for a difference of 42 RMS in 6 cycles of quill traverse. The conventional stone, on the other hand, reduced the finish from 50 to 13 RMS for a difference of 37 RMS in 6 cycles of quill traverse. This is due to the superior metal removal rate of the stone embodying the invention.

I claim as my invention:

1. A superfinishing stone for micro-finish machining of a workpiece and comprising, in combination:
   (a) a metallic body of block-like form;
   (b) means defining an arcuate contour face in said body, said contour face being substantially complementary to the contour of a workpiece to be superfinished;
   (c) means defining a coolant supply passage in said body extending longitudinally of said contour face;
   (d) means defining a plurality of unrestricted coolant discharge passages communicating between said coolant supply passage and said contour face;
   (e) a coated abrasive liner having an area coextensive with said contour face, said liner having unrestricted apertures therethrough adapted to register with said discharge apertures in said body;
   (f) means for adhesively laminating said liner to said contour face;
   (g) means defining a leading edge and a trailing-edge on said contour face with respect to the direction of rotation of the workpiece; and
   (h) said discharge apertures being situated adjacent the leading edge of said contour face.

2. A superfinishing stone for micro-finish machining of a workpiece and comprising, in combination:
   (a) a metallic body of block-like form;
   (b) means defining an arcuate contour face in said body, said contour face being substantially complementary to the contour of the workpiece to be superfinished;
   (c) means defining a coolant supply passage in said body extending longitudinally of said contour face;
   (d) means defining a plurality of unrestricted coolant discharge passages communicating between said coolant supply passage and said contour face;
   (e) a coated abrasive liner having an area coextensive with said contour face, said liner having unrestricted apertures therethrough adapted to register with said discharge apertures in said body;
   (f) means for adhesively laminating said liner to said contour face, said adhesive securing means being a layer of pressure-sensitive adhesive material having apertures therethrough adapted to register with said coolant discharge apertures in said body and the apertures in said coated abrasive liner;
   (g) means defining a leading edge and a trailing-edge on said contour face with respect to the direction of rotation of the workpiece; and
   (h) said discharge apertures being situated adjacent the leading edge of said contour face.

3. The method of making a superfinishing stone for microfinish machining of a workpiece and comprising the steps of:
   (a) providing a body of readily machinable metal;
   (b) machining a contour face on said body substantially complemental to the contour of the workpiece to be superfinished by said stone;
   (c) applying an adhesive substrate of substantially uniform thickness to said contour face;
   (d) laminating a coated abrasive liner to said body by means of said adhesive;
   (e) pressing said body against a form corresponding to the workpiece to be finished to conform said adhesive liner to the contour thereof;
   (f) forming a main coolant passage in said body;
   (g) forming a plurality of discharge passages communicating between said main coolant passage in said body and the face of said abrasive liner; and
   (h) locating said plurality of discharge passages adjacent the leading edge of said stone.

4. The method of making a superfinishing stone for microfinish machining of a workpiece and comprising the steps of:
   (a) providing a body of readily machinable metal;
   (b) machining a contour face on said body substantially complemental to the contour of the workpiece to be superfinished by said stone;
   (c) applying an adhesive substrate of substantially uniform thickness to said contour face;
   (d) laminating a coated abrasive liner to said body by means of said adhesive;
   (e) pressing said body against a form corresponding to the workpiece to be finished to conform said adhesive liner to the contour thereof;
   (f) forming a main coolant passage in said body;
   (g) forming a plurality of discharge passages communicating between said main coolant passage in said body and the face of said abrasive liner;
   (h) locating said plurality of discharge passages adjacent the leading edge of said stone; and
   (i) said adhesive substrate and said abrasive liner being pre-cut and formed with pre-punched apertures therein for registration with said discharge apertures in said body.

* * * * *

UNITED STATES PATENT AND TRADEMARK OFFICE

CERTIFICATE OF CORRECTION

PATENT NO. : 4,240,232

DATED : December 23, 1980

INVENTOR(S) : John C. Chwae

It is certified that error appears in the above—identified patent and that said Letters Patent is hereby corrected as shown below:

Column 5, line 5, "filter" should read --filler--.

Column 6, line 53, "Company" should read --Corporation--.

Signed and Sealed this

*Fifteenth* Day of *June 1982*

[SEAL]

*Attest:*

GERALD J. MOSSINGHOFF

*Attesting Officer*

*Commissioner of Patents and Trademarks*